United States Patent [19]

Blechner et al.

[11] Patent Number: 4,580,617

[45] Date of Patent: Apr. 8, 1986

[54] INDUCTION CASTING MACHINE AND METHOD OF CASTING

[76] Inventors: Charles Blechner, 10 Robbins La., Great Neck, N.Y. 11020; David F. Pascoe, 6 Stirrup La., Port Jefferson, N.Y. 11777

[21] Appl. No.: 649,282

[22] Filed: Sep. 11, 1984

Related U.S. Application Data

[63] Continuation of Ser. No. 375,693, May 7, 1982, abandoned, which is a continuation-in-part of Ser. No. 263,752, May 14, 1981, abandoned.

[51] Int. Cl.[4] ..... B22D 18/00

[52] U.S. Cl. ..... 164/493; 164/61; 164/66.1; 164/119; 164/507

[58] Field of Search ..... 164/113, 119, 66.1–68.1, 164/492–495, 512–514, 259, 285, 507, 61

[56] References Cited

U.S. PATENT DOCUMENTS

| | | | |
|---|---|---|---|
| 983,579 | 2/1911 | Taggart | 164/119 |
| 1,004,185 | 9/1911 | Nies | 164/119 X |
| 1,244,257 | 10/1917 | Sweetnam . | |
| 1,657,475 | 1/1928 | Inami . | |
| 2,097,093 | 10/1937 | Berryman . | |
| 2,147,103 | 2/1939 | McKee . | |
| 2,171,778 | 9/1939 | Yantis | 164/150 |
| 2,274,186 | 2/1942 | Brace . | |
| 2,392,929 | 1/1946 | Lee . | |
| 3,005,232 | 10/1961 | Steinbock et al. . | |
| 3,149,374 | 9/1964 | Wagner . | |
| 3,587,722 | 6/1971 | Slansky | 164/376 |
| 3,623,541 | 11/1971 | Schmitz | 164/337 |
| 3,674,083 | 7/1972 | Stier et al. | 164/251 |
| 3,741,280 | 6/1973 | Kozheurov et al. | 164/250 |
| 3,768,544 | 10/1973 | Padeh | 164/376 |
| 3,780,787 | 12/1973 | Rasmussen | 164/35 |
| 3,844,755 | 10/1974 | Angle et al. | 65/32 |
| 3,845,807 | 11/1974 | Koon | 164/255 |
| 3,989,088 | 11/1976 | Weissman et al. | 164/157 |
| 4,199,343 | 4/1980 | Eolin et al. | 65/157 |
| 4,254,817 | 3/1981 | Kidowaki et al. | 164/259 X |

FOREIGN PATENT DOCUMENTS

| | | | |
|---|---|---|---|
| 860846 | 1/1971 | Canada | 164/119 |
| 60206 | 2/1911 | Switzerland | 164/338.1 |

OTHER PUBLICATIONS

"Melting and Casting of Alloys", published in Alternatives to Gold Alloys in Dentistry, Conference Proceedings Jan. 24–26, 1977, pp. 166–185 (U.S. Dept. of Health, Education and Welfare, Publ. No. NIH 77-1227).

*Primary Examiner*—Kuang Y. Lin

*Attorney, Agent, or Firm*—Morgan, Finnegan, Pine, Foley & Lee

[57] ABSTRACT

A casting system includes an enclosure for covering a bowl-shaped entry port to an investment cavity for use in the lost-wax casting process. A delivery system is provided for delivering an inert gas to the enclosure to displace the original atmosphere which is driven out an exit port. The gas delivery system also provides a high-pressure environment in the enclosure for forcing molten metal, contained in the entry port, to pass by sprues into the mold cavity. Induction heating is provided for melting a solid metal ingot, controlled by a timer and pyrometer to occur prior to the injection, as well as during and optionally subsequent to the injection of compressed inert gas. The casting system is particularly useful for light-weight metals which can be cast only with difficulty in a centrifuge and is also modified for application to glass ingots and metals which do not heat well by induction.

34 Claims, 6 Drawing Figures

INDUCTION CASTING MACHINE AND METHOD OF CASTING

This is a continuation of application Ser. No. 375,693 filed May 7, 1982, which, in turn, is a continuation-in-part of U.S. Ser. No. 263,752, filed May 14, 1982, both abandoned.

BACKGROUND OF THE INVENTION

1. Field of the Invention

The present invention relates generally to casting apparatus and, more particularly, to certain new and useful improvements in apparatus and methods for the automatic casting of precision castings such as dental prostheses, jewelry and small precision parts.

2. Description of the Prior Art

Dental castings, such as dentures, crowns and bridges, are a frequent example of castings requiring great precision to fit properly. Typically, heretofore such castings have been made by the use of the lost wax process with a mold constructed of a porous investment. The investment has a cavity which is to be filled with molten metal such as a gold or nickel alloy. An entry port to the cavity may be formed as a hemispherical depression in the outer surface of the investment. The entry port is connected by sprues to the cavity. The following procedure has been used. An ingot of the metal to be cast is first placed in a separate crucible and heated as by means of a blow torch or induction coil. Thereafter, the molten metal is forced to flow from the crucible into the entry port of the mold, and then via the sprues into the cavity by centrifuging the crucible together with the mold. Where heating is done by an induction coil, the coil is placed around the crucible at a distance from the mold since the iron ring, or flask, which has often been used for enclosing the investment would deter the electromagnetic energy from reaching the ingot. Such a heating, or melt, coil is removed from the crucible prior to the centrifuging. The speed of flow of the metal must be high enough to fill the mold completely prior to freezing, or solidification, of the metal along the surfaces of the sprues and the cavity. Entrapped air in the cavity may exit through a vent sprue or through the pores of the investment material under the pressure of the advancing metal. The investment material is typically a refractory ceramic such as silica held together by a binder such as gypsum.

As heretofore practiced, a problem has arisen in that, during the heating of the metal ingot, impurities from the atmosphere and from the heating flame are absorbed into the molten metal and carbon from the heating flame further contaminates the resulting castings. A further problem has arisen in castings made with lower density metals wherein the resulting forces of a centrifuge are reduced, increasing the chances of voids in the casting due to the reduced forces. Alternatively, as a result of the reduced forces available, it has also heretofore been a common practice to utilize an excess amount of molten metal, often as much as twice that required for the desired cast, in an attempt to insure that the desired amount of molten metal is forced into the mold cavity. This practice is economically disadvantageous from a materials standpoint and also because it leaves oxide impurities on the crucible surface which must be removed. Remelting and reuse of the excess metal is also both economically disadvantageous and undesirable.

While early workers in the casting field heated the metal by means of a torch directly in the entry port to the mold sprue system, the entry port serving as a crucible, the more recent practice has been to heat the metal at a remote crucible, often to temperatures in excess of the melting temperature, followed by a rapid delivery of the molten metal to the mold as by use of the centrifuge. Although the earlier practice is preferable in that less heat is lost during transfer of the metal from the crucible to the mold cavity, that practice suffered a disadvantage in that the metal flasks which contained the investment would not admit the use of induction heating which could be employed at the remote crucible. Present day investment materials do not require the metal flask for adequate mold strength. In addition, both procedures are often practiced by the use of temperatures substantially in excess of the melting temperature of the metal, which is harmful to the properties of the casting material.

It is known that the effects of thermal expansion/contraction between the casting and the mold can be compensated for by preheating the mold, whereby, upon cooling of the casting, dimensional accuracy is assured. However, in this respect, another problem has arisen in the foregoing casting processes in that independent control of the mold temperature and the metal temperature cannot be provided simultaneously. As previously practiced, whether the metal is heated at the crucible or remote from the crucible, it has not been possible to maintain heating of the metal during passage through the sprues and within the cavity so as to retard solidification until the cavity is completely filled.

3. Objects of the Invention

It is therefore an object of this invention to provide novel and improved apparatus and methods for automatic precision casting.

Another object of this invention is to provide novel and improved apparatus and methods for automatic precision casting which eliminate or overcome the shortcomings and disadvantages of previously known casting apparatus and methods.

Another object of this invention is to provide novel and improved apparatus and methods for automatic precision casting which obtain castings of greatly improved quality with greatly improved reliability and economic advantages.

Another object of this invention is to provide novel and improved apparatus and methods for automatic precision casting which eliminates the need for a separate melting crucible or a metal casing ring surrounding the investment material of the mold and permits casting with both the molten cast material and the investment material maintained at lowered temperatures.

Objects and advantages of the invention are set forth in part herein and in part will be obvious herefrom, or may be learned by practice with the invention, the same being realized and attained by means of the instrumentalities and combinations pointed out in the appended claims.

The invention consists of the novel parts, constructions, arrangements, combinations, steps, processes and improvements herein shown and described.

SUMMARY OF THE INVENTION

Briefly described, the casting system of the present invention provides for a melting of the metal for the casting while protecting the metal from impurities during the melting process and during a subsequent injection of the metal into the mold cavity. In accordance with the invention as preferably embodied, the thermal energy which melts the metal is also applied to the metal during and subsequent to the injection of the metal into the mold cavity. Sufficient pressure is applied to the molten metal to insure a rapidity of injection which precludes premature freezing of the metal.

In accordance with the invention, the casting system comprises an enclosure for the metal ingot. The enclosure is connected to a pressurized source of an inert gas, such as argon, to displace atmospheric impurities. The mouth of the enclosure is sealed to the entry port of the mold to protect the ingot and the subsequent molten metal from such atmospheric impurities. The enclosure is fabricated from a material, such as ceramic, which is dimensionally stable in the presence of the elevated temperature of the molten metal and which is transparent to the propagation of electromagnetic energy to permit the heating of the metal by electromagnetic induction. The system further includes a coil, excited by alternating current, which surrounds the enclosure, and applies a time varying electromagnetic field to the metal within the enclosure to melt the metal. As preferably embodied, the enclosure, mold and coil are constructed so that the coil encloses both the enclosure and the mold cavity, and the application of heat to the metal is maintained until such time as the molten metal enters the cavity, and thereafter if desired. Thus, the metal to be molded is kept free from the impurities associated with heating by an open flame, and maintenance of its molten state is assured until it reaches the cavity within the mold.

In accordance with the invention, as preferably embodied, the mold is provided with a bowl-shaped entry port which serves as a preheated crucible wherein the ingot or ingots are heated and melted. The mold is positioned with the entry port, or crucible, on top so that the ingot or ingots to be molded are held within the crucible and also partially within the enclosure. As alternatively embodied, the mold and enclosure may be integral and/or may be of a single diameter. Also alternatively, the heating coil may surround only that portion of the enclosure and mold containing the crucible and casting material ingots. One or more sprues extend downwardly from the crucible to the mold cavity. A flow of the inert gas is maintained during the heating of the ingot under a relatively small increase of pressure, for example, ½ p.s.i. (pounds per square inch), to drive out impurities in the atmosphere which may emanate from the heated investment of the mold, the investment being heated typically to a temperature on the order of 1600°–1700° F., but which in accordance with the present invention may be heated to a temperature as low as about 1400° F., in an oven prior to the casting operation. Alternatively, the chamber may be evacuated prior to the introduction of the inert gas. The diameters of the sprues are dimensioned so that upon melting of the ingot or ingots the surface tension of the molten metal is sufficient, even in the presence of the foregoing small pressure increment associated with the purging of impurities by the inert gas, to maintain the molten metal within the crucible. Thus, the surface tension retains the molten metal in the crucible until such time as it is to be injected into the mold cavity.

At the completion of the melting process, a sudden application of high pressure gas from the source of inert gas is applied to the interior of the enclosure. An orifice through which the high pressure gas enters the enclosure is preferably directed toward a wall of the enclosure away from the molten metal so as to prevent a splashing of the metal. The high pressure gas rapidly forces the molten metal through the sprues and into the mold cavity in an interval of time which is short enough, essentially instantaneous, to preclude the solidification of any more than a negligible amount of the metal along the surfaces of the sprues and the cavity.

It will be apparent from the foregoing general description that the objects of the invention specifically enumerated herein are accomplished by the invention as here embodied.

Thus, upon practice of the apparatus and methods of the invention, it has been found that the mold cavity is consistently filled with a pure metal which is remarkably free of impurities and which subsequently solidifies to provide a very precise casting remarkably free of voids and surface imperfections. Moreover, very little excess casting material is required to insure a sound, precise casting and miscasts are minimal.

While it is not intended to predicate patentability on any particular theory or feature, it is believed that the ability of the system of the present invention to attain a pure molten material combined with the speed of the injection achieved by means of pneumatic pressure is responsible for the consistently remarkably improved castings obtained.

A further advantage of the apparatus and methods of the present invention is that they permit castings to be carried out at the minimum temperature required to melt the casting material and also permit the investment material of the mold to be preheated to a lower temperature than previously practiced. These minimum or lowered temperatures also contribute to the ability to achieve castings which are more completely filled out, and have greater density and loss porosity.

The casting system of the present invention may also be utilized for the casting of nonmetallic material, such as glass, by placing a chemically inert, metallic insert into the entry port of the mold. The insert is bowl shaped for supporting an ingot or ingots of the casting material and, upon interacting with the electromagnetic field, becomes hot and melts the nonmetallic casting material.

It will be understood that the foregoing general description and the following detailed description as well are exemplary and explanatory of the invention but are not restrictive thereof.

The accompanying drawings, referred to herein and constituting a part hereof, illustrate preferred embodiments of the invention, and together with the description, serve to explain the principles of the invention.

DESCRIPTION OF THE PREFERRED EMBODIMENTS

Figure 1:
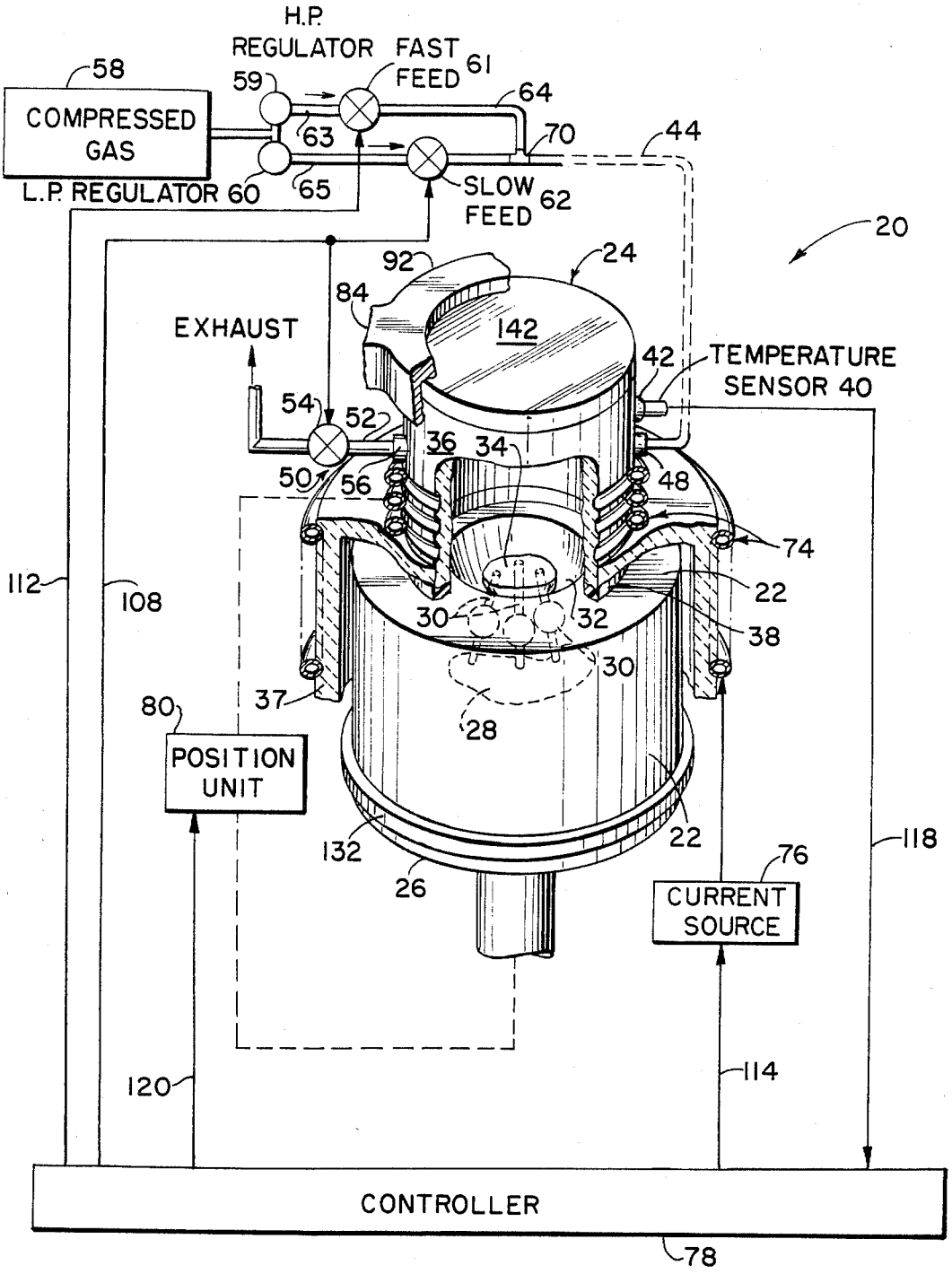
FIG. 1 is a stylized pictorial view of a casting system in accordance with the invention, a portion of an enclosure being deleted to show an investment in a raised position for casting, and other portions of the system being shown diagrammatically.
Figure 2:
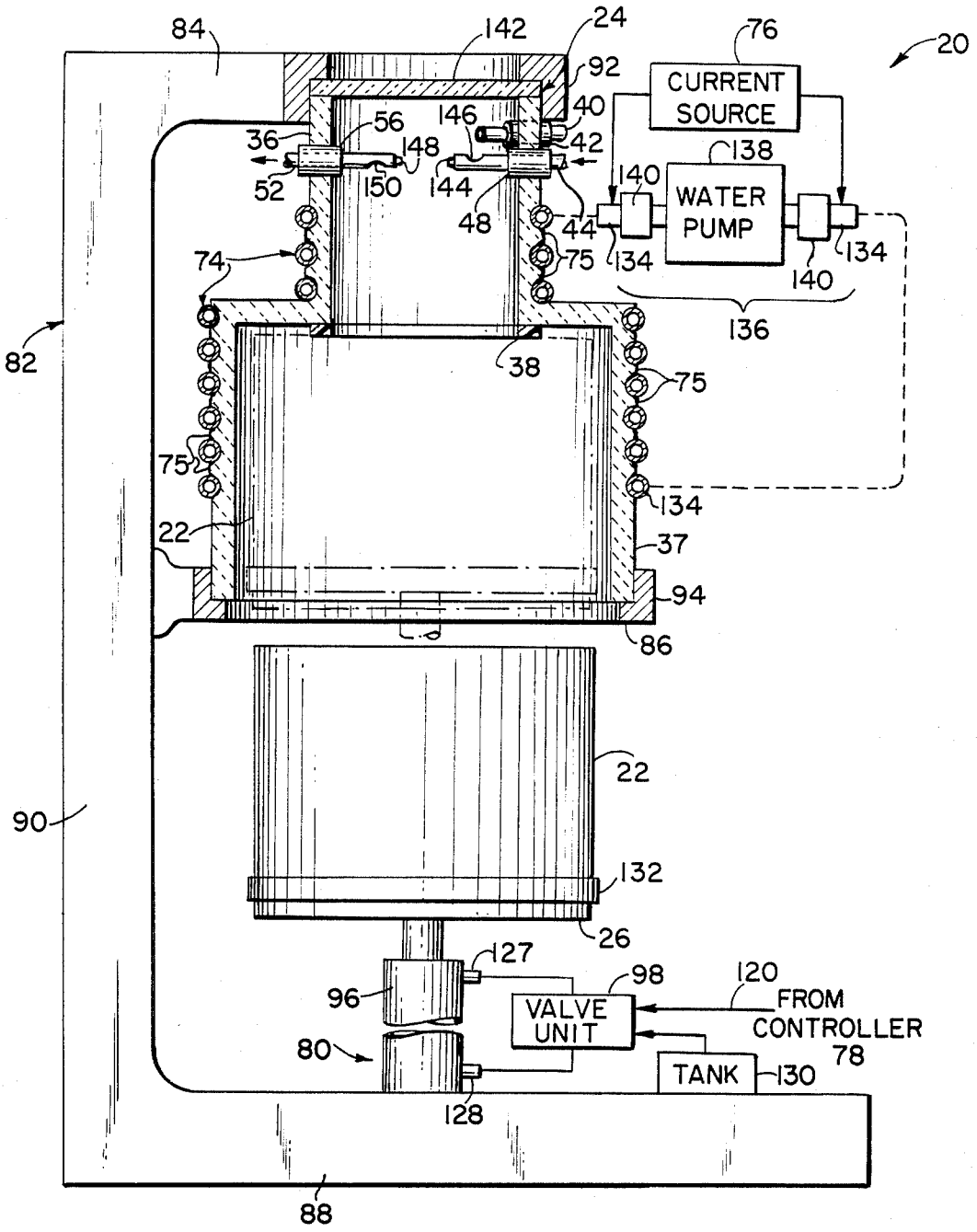
FIG. 2 shows a sectional view of the enclosure of FIG. 1 with a melt coil supported thereon and the investment shown in a lowered position withdrawn from the enclosure, the figure further showing a positioning unit for raising and lowering the investment relative to the enclosure.

Referring now to FIGS. 1 and 2, there is shown a casting system 20 embodying the invention. An investment 22 is removably positioned in an enclosure 24 by a piston 26. The investment 22 has an interior cavity 28 and sprues 30, both shown in phantom, the sprues 30 coupling the cavity 28 to an exterior depression in the top surface of the investment 22. The depression serves as a crucible 32 for supporting one or more ingots shown at 34 during heating of the ingot or ingots 34 and also serves as the entry port by which molten metal enters the investment cavity.

Advantageously, in accordance with the invention, sprues 30 and their mating openings in the bottom of crucible 32 are dimensioned so that the surface tension of the molten casting material is sufficient to prevent the molten material from draining into sprues 30 prior to the application of the injection molding pressure, more fully described hereinafter. To this end, it has been found that for precisions metals such as gold, gold alloys and chrome - cobalt alloys, sprue 30 is advantageously approximately 14 guage, or 0.064" (1.63 mm) in diameter; for non-precious metals such as nickel - chrome alloys, sprue 30 is advantageously approximately 8 gauge, or 0.128" (3.26 mm) in diameter.

The enclosure 24 is formed of a ceramic, such as alumina (aluminum oxide) which is transparent to the propagation of electromagnetic energy. The upper portion of the enclosure 24 comprises a cap 36 and the lower portion of the enclosure 24 comprises a skirt 37 depending from the cap 36. A refractory seal 38, which may be fabricated of asbestos, is provided at the lower lip of the cap 36 for sealingly mating with the top surface of the investment 22 upon a raising of the investment 22 by the piston 26.

A temperature sensing element such as a pyrometer 40 is inserted through the wall of the cap 36 and secured therein by a grommet 42. An inlet pipe 44 passes through the wall of the cap 36 and is secured thereto by a grommet 48. An exhaust port 50 comprises a pipe 52 with a valve 54 at an outer end thereof, the inner end of the pipe 52 passing through the wall of the cap 36 and being secured thereby to a grommet 56.

A tank 58 feeds compressed gas by a pair of pressure regulators 59–60, the gas being stored within the tank 58 at a pressure of approximately 3000 p.s.i. (pounds per square inch), while the regulator 59 is set at a pressure of approximately 50 p.s.i. and the regulator 60 is set at a relatively low pressure of approximately ½ p.s.i. The gas is conveyed from the regulators 59–60, as shown schematically, via valves 61–62, tubes 63–65 and the pipe 44 to the enclosure 24. The tube 64 is coupled to the pipe 44 by a tee 70 in the pipe 44.

A melt coil 74, shown disposed coaxially to the enclosure 24, is supported in ridges 75 along the outer surface of the enclosure 24 and is energized by electric alternating current from a source 76 which is activated by a controller 78. Current within the coil 74 provides a time varying electromagnetic field which interacts with the metal of the ingot or ingots 34 for heating the metal of the ingot or ingots by electromagnetic induction.

Advantageously, and as preferably embodied, coil 74 surrounds both the cap 36 and the skirt 37 of the enclosure 24 so as to provide heat to the metal during its solid state in the ingot 34, during its molten state within the crucible 32 and subsequently as it passes through the sprues 30 into the cavity 28. As preferably embodied, the diameter of the cap 36 is less than the diameter of the skirt 37; similarly, the diameter of the upper portion of the coil 74, surrounding the cap 36, is smaller than the diameter of the lower portion of the coil 74, surrounding the skirt 37. Thereby, the reduced diameter of the upper portion of the coil 74 provides for the concentration of the magnetic flux at the site of the ingot 34 so as to accomplish a more rapid melting thereof. Furthermore, the heating of the metal can be continued even beyond the actual casting process by an interval of approximately one to two seconds as will be described hereinafter.

Figure 6:
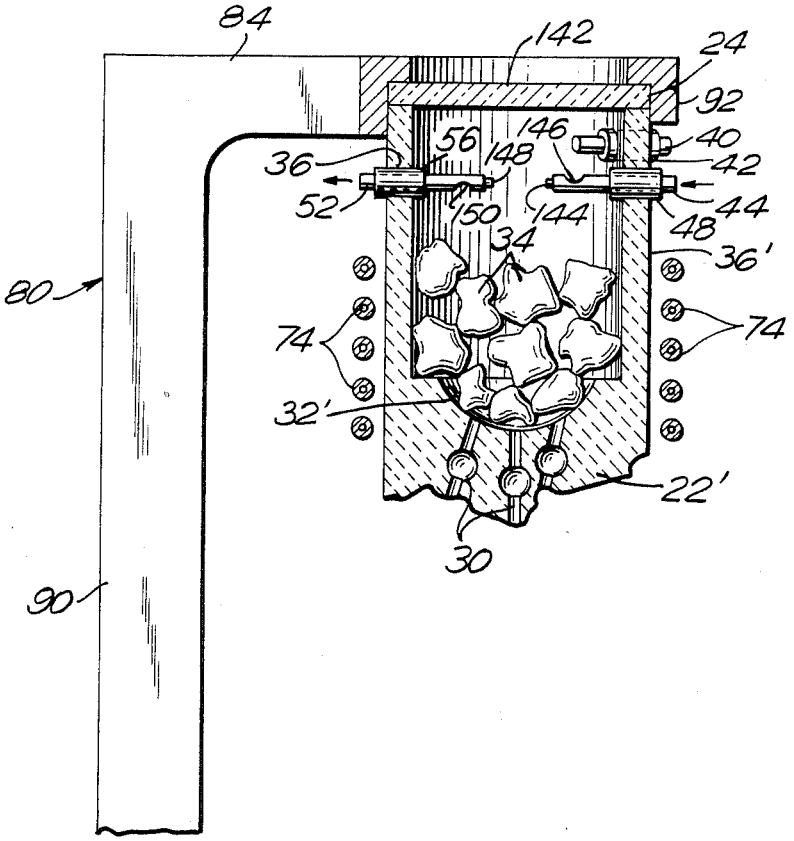
FIG. 6 is a further fragmentary sectional view similar to FIG. 2 illustrating a further alternative embodiment of the invention wherein the enclosure for the ingots and the investment are of the same diameter and constructed as a single integral member and the induction coil is supported closely adjacent to but separate from the enclosure and investment members.

Alternatively, as shown in FIG. 6 described more fully hereinafter, it will be understood that the enclosure 24 and investment 22 may be formed as a single integral member, thereby eliminating the need for sealing ring 38. As a further alternative, whether in the single integral structure shown in FIG. 6 or in the preferred embodiment illustrated in FIGS. 1–4, it also will be understood that the investment 22 and enclosure 24 may be of the same diameter.

Advantageously, positioning unit 80, indicated schematically in FIG. 1 and presented in detail in FIG. 2, supports the enclosure 24 and adjusts the height of the piston 26 relative thereto. As preferably embodied, positioning unit 80 comprises a frame 82 having an upper arm 84, a lower arm 86, and a base 88 which are spaced apart by a vertical leg 90. The upper arm 84 advantageously terminates in a circular lip 92 which mates with the upper edge of the cap 36. The lower arm 86 also advantageously terminates in a circular lip 94 which mates with the lower lip of the skirt 37. The upper and lower arms 84 and 86 thereby fixedly position the enclosure 24 relative to the base 88. The positioning unit 80 further advantageously includes a hydraulic drive 96 which couples the piston 26 to the base 88. The drive 96 is driven by hydraulic fluid coupled thereto by a valve unit 98 in response to signals from the controller 78.

Figure 3:
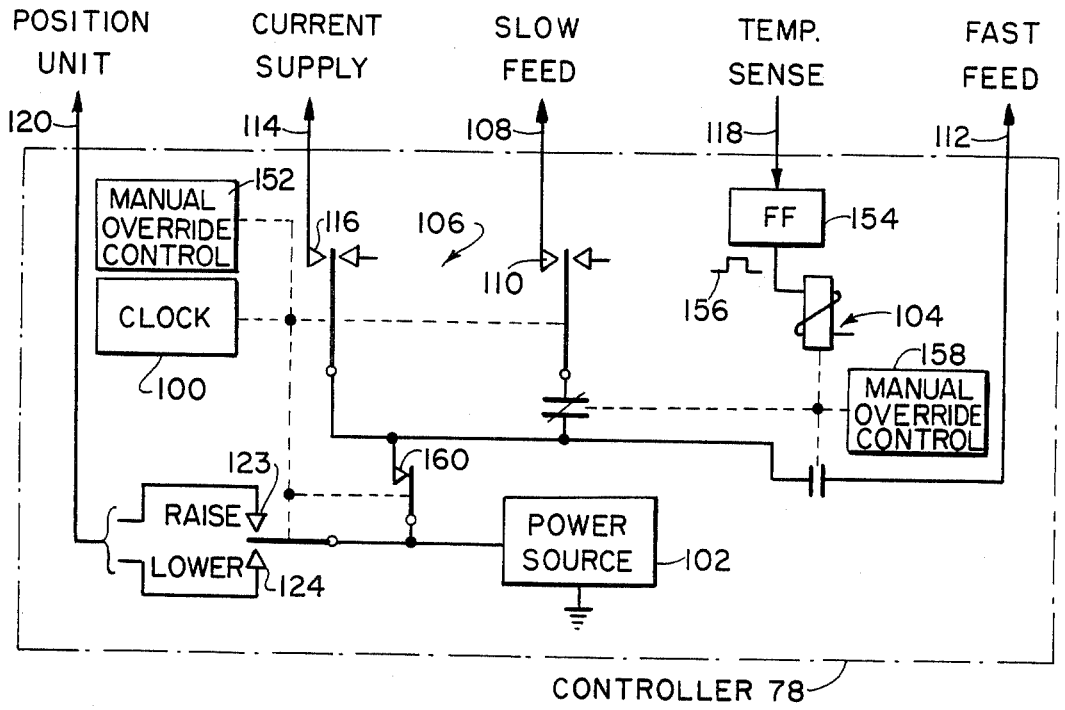
FIG. 3 shows a controller of FIG. 1.

Referring also to FIG. 3, there is shwon a diagrammatic view of an exemplary embodiment of the controller 78 of FIG. 1. The controller 78 comprises a clock 100, a power source 102, a relay 104, and a stepping switch 106 which is operated by the clock 100 and has terminals coupling electric lines of FIG. 1 to the power source 102. Line 108 couples the valves 54 and 62 of FIG. 1 to terminal 110 of the switch 106. Line 112 couples the valve 61 of FIG. 1 to an output terminal of the relay 104. Line 114 couples the current source 76 of FIG. 1 to terminal 116 of the switch 106. Line 118 couples the pyrometer 40 of FIG. 1 to a control terminal of the relay 104 for connecting the line 112 to the source 102 to activate the valve 61. Line 120 includes two electrical conductors for connecting with terminals 123–124 of the switch 106 for actuating valves of the valve unit 98 to direct hydraulic fluid respectively via ports 127–128 of the drive 96 for raising and lowering the piston 26. The hydraulic fluid is provided to the valve unit 98 by a tank 130 of pressurized fluid.

As shown in FIG. 2, the piston 26 includes an insulator 132 of refractory material such as asbestos for thermally insulating the piston 26 from the investment 22. During molding and casting operations, an investment such as the investment 22 is preferably preheated to a temperature which is lower than the freezing point of the metal of the ingot 34 but is sufficiently high so as to compensate for casting shrinkage by inversion expansion thereby insuring dimensional accuracy of the final casting. Although as previously practiced, this temperature is usually on the order of 1600°–1700° F., it has been found with the present invention that this temperature may be as low as about 1400° F. The insulator 132 permits the investment 22 to remain at the high temperature by inhibiting the conduction of heat from the investment 22 to the relatively cold metal of the piston 26.

With respect to the energization of the coil 74 with current from the source 76, it may be desirable to restrict any rise in temperature of the conductors 134 of the coil 74 due to the passage of current therethrough. Accordingly, it is advantageous to construct the conductors 134 of hollow copper tubing, the ends of which are connected to a cooling unit 136. The cooling unit 136 comprises a water pump 138 coupled by electrically-insulating rubber tubing to the ends of the conductors 134. Thereby, cooling water can be circulated through the conductors 134 while electric current is applied thereto by the current source 76.

The cylindrical wall of the cap 36 is closed off at the top by a window 142 which advantageously is formed of a circular plate of high temperature glass, such as oven glass, to permit observation of the melting of the ingot 34. The interior end of the pipe 44 is closed off by a plug 144, and an opening 146 is provided on the top side of the pipe 44 to direct the flow of inert gas from the pipe 44 towards the window 142, rather than downwardly towards the investment 22, so as to provide a more uniform distribution of the fluid flow and thereby prevent a splashing of the molten metal in the crucible 32. The pipe 52 of the exhaust port 50 is similarly provided with a plug 148 to close off the interior end of the pipe 52, and is provided with an opening 150 in the side of the pipe facing downward so as to provide a direction of fluid flow within the cap 36 that more rapidly eliminates the original air atmosphere upon the application of the inert gas by the opening 146.

Figure 4:
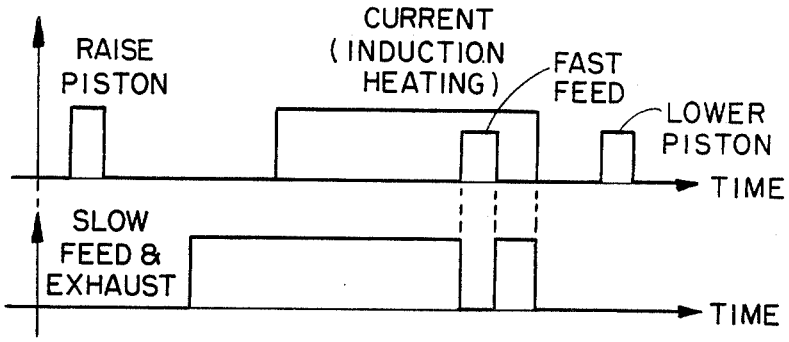
FIG. 4 is a timing diagram for the operation of the system of FIG. 1.

In operation, therefore, and with reference also to the timing diagram of FIG. 4, the switch 106 is driven by the clock 100. A manual override control 152 is mechanically coupled to the switch 106 to provide for manual operation of any one of the switching functions in the event that such manual operation is desired. In the absence of implementation of the manual override, the switching functions of the switch 106 proceeds sequentially, and automatically, under control of the clock 100. Initially, the preheated investment 22, with ingot or ingots 34 set in the crucible 32, is positioned on the insulator 132 of the piston 26. This is followed by the automatic sequencing of the controller 78. The terminal 123 is first connected to the power source 102 to activate the valve 98 and the drive 96 to raise the piston 26, whereupon the investment 22 is brought into contact with the seal 38. The piston 26 urges the investment 22 against the seal 38 with sufficient pressure so as to provide an airtight seal at the interface between the seal 38 and the investment 22. The force exerted by the piston 26 is sufficient to overcome hydrostatic forces which subsequently develop within the cap 36 upon the application of the inert gas by the inlet pipe 44.

The terminal 110 is then connected to the power source 102 for activating the valves 54 and 62 of FIG. 1 to provide for the slow feeding of inert gas, such as argon, by the pipe 44 to sweep out air from the cap 36 by the pipe 52. The tube 65 has a bore which is substantially narrower than that of the tube 63 so that, in combination with the low pressure of the regulator 60, a gentle stream of the inert gas exits from the opening 146 for sweeping out the air from the cap 36.

Upon further operation of the switch 106 by the clock 100, the contact closes at terminal 116 to provide an electric signal on line 114 which triggers the operation of the current source 78. Thereupon, induction heating of the ingot or ingots 34 proceeds with the resultant melting of the ingot or ingots 34. During the melting of the ingots 34, the gentle flow of the inert gas by the inlet pipe 44 is maintained to sweep out any further vapors which may emanate from the metal or from the pores of the investment 22. The pyrometer 40, upon sensing that the metal of the ingot or ingots 34 has been heated to a sufficiently high temperature to complete the melting process, transmits an electric signal along the line 118 to trigger a flip flop 154 and activate a relay 104. The flip flop 154 generates a pulse 156 having a duration of approximately two seconds which energizes the coil of the relay 104 for a corresponding interval of two seconds. The relay activates the valve 61, via a normally open set of contacts 157A on line 112, and deactivates the valve 54 and 62 by a normally closed contact set 157B in series with the line 108. Thereupon, the slow feed by the valve 62 and the exhaust by the valve 54 are terminated, and the inert gas is fed rapidly through the valve 61 and the pipe 44 to produce a sudden increase in gas pressure with the cap 36. The increase of gas pressure is limited to the preset value of the regulator 59. Although a pressure as low as about 15 p.s.i. has been found to operate satisfactorily within gold alloys, it is preferred that the pressure be in the range of from about 30 to no more than about 100 p.s.i., and preferably on the order of the aforementioned 50 p.s.i.

The sudden increase in gas pressure forces the molten metal via the sprues 30 into the cavity 28 to cast the metal. The casting of the metal occurs in approximately one-tenth second or, essentially instantaneously. At the conclusion of the pulse 156 of the flip flop 154, the relay 104 is deactivated with a resulting closing of the fast feed valve 61 and a reopening of the exhaust valve 54 and the slow feed valve 62. The opening of the exhaust valve 54 provides for a release of the gas pressure within the cap 36, as indicated in the lower graph of the timing diagram of FIG. 4. The current in the coil 74 continues to flow for a period of one to two seconds after the termination of the fast feed, so as to maintain the induction heating of the metal beyond the casting process. A manual override control 158 connects with the contacts of the relay 104 for operation thereof in the event it is desired to override the operation of the relay 104. Further operation of the switch 106 by the clock 100 opens the contact at the terminal 160 to terminate the electric signals on lines 114 and 108 to terminate the flow of current in the coil 74 and to deactivate the valves 54 and 62. The contact at terminal 124 of the switch 106 closes to activate the drive 96 to return the piston 26 to its lowered position to permit retrieval of the investment 22 from the casting system 20. Thereupon, the investment 22 may be fractured to obtain the casting.

The foregoing melting and casting of the metal of the ingot or ingots has made use of the property of the metal wherein metal interacts with a time varying electromagnetic field to establish eddy currents in the metal with the resultant heating and melting of the metal. However, there are situations wherein it may be desired to form a casting from a nonmetallic material such as glass. Since such a material does not undergo the foregoing interaction with the electromagnetic field, provision must be made for extracting energy from the field to melt the material as will now be described with reference to FIG. 5.

Figure 5:
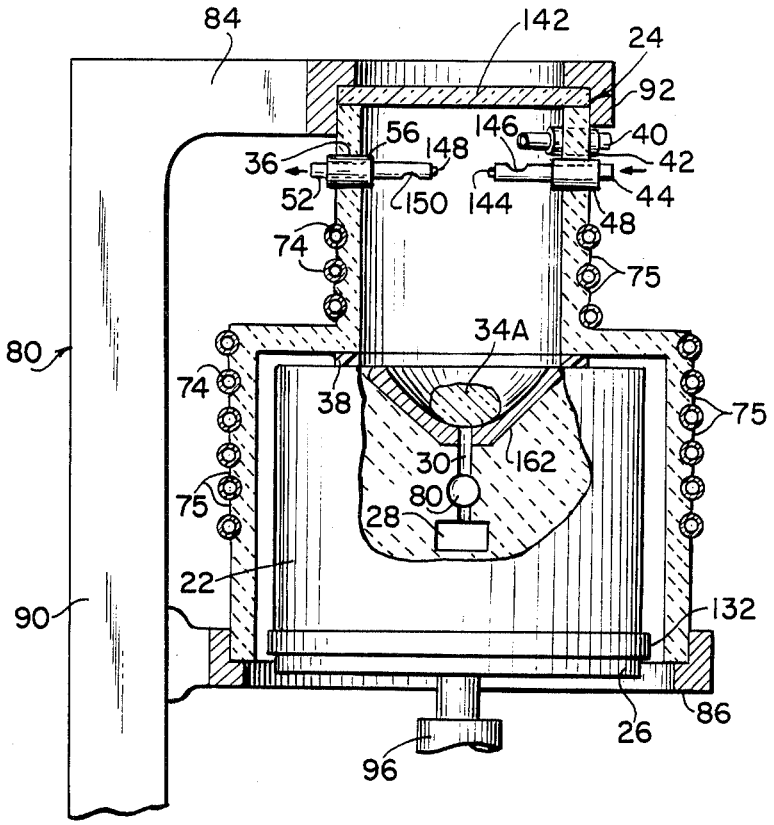
FIG. 5 is a fragmentary sectional view similar to FIG. 2, shown in the raised position, illustrating an alternative embodiment of the invention wherein the mold includes a metallic insert set in the crucible entry port so that nonmetallic ingots may also be cast in accordance with the invention.

Referring now to the embodiment of the invention shown in FIG. 5, an insert 162 of an electrically conducting metal is inserted into the entry port of the investment 22 for melting a nonmetallic ingot 34A such as a glass ingot in the situation wherein it is desired to cast a nonmetallic material. A metal such as platinum is preferred for use in constructing the insert 162 since platinum has a higher melting temperature than the glass ingot 34A, and is chemically inert with respect to the glass ingot. The insert 162 is similarly preferably bowl-shaped and has one or more openings in its bottom for communication with the sprues 30 of the investment 22. The location and orientation of the insert 162 relative to the electromagnetic field of the coil 74, and the axis of symmetry of the insert being parallel to the applied field, are selected to provide for the interception of the electromagnetic field and the induction of circulating currents which heat the insert 162. Heat flows from the insert 162 into the glass ingot 34A, heating and melting the ingot. As in the use of metal, the crucible openings and mating sprues are dimensioned such that the surface tension of the molten glass supports same in the crucible until the application of gas pressure occurs. Advantageously, this dimension is on the order of an 8 gauge sprue. Thereafter, as taught previously with respect to the metal ingot 34, the molten glass is forced by pressure of the inert gas through the sprues 30 into the investment cavity 28 where the glass solidifies upon cooling. Thereby, nonmetallic material can be melted and cast.

As a further alternative to the invention as embodied in FIG. 5, it has also been found advantageous for particular casting materials, such as gold, which do not readily heat up by induction heating, to line the crucible and/or the inner surface of the enclosure with a chemically inert metallic material or carbonaceous material such as graphite.

Referring now more particularly to FIG. 6 of the accompanying drawings, there is illustrated further alternate embodiments of the invention. As here embodied, the upper portion of the enclosure, designated generally by reference numeral 36', is constructed as an integral extension of the investment, designated by reference numeral 22', thereby eliminating refractory seal 38 shown in the embodiment of FIGS. 1–4. Also as here embodied, ingots 34 are supported in crucible 32' of investment 22' so as to be contained largely within the upper enclosure portion 36'. Finally as here embodied, melt coil 74 is suitably supported closely adjacent to but separate from enclosure 36' and investment 22', and surrounds only those portions containing the crucible 32' and ingots 34. As here embodied, the molten casting material is injected into the mold cavity in the manner previously described, except that heating of coil 74 is not continued beyond the actual casting process. Although it is preferred that melt coil 74 also surround that portion of the investment containing the mold cavity, entirely satisfactory castings, having the aforementioned greatly improved density and smoothness characteristics, have been obtained with this alternate embodiment of the invention. Also, as in the previous embodiments, it will be understood that enclosure 36' may have either the same or a reduced diameter from that of investment 22'.

Also, it will be understood that the crucible 32' may be lined with metal as illustrated in FIG. 5 for use with glass ingots, or the enclosure 36' and/or crucible 32' lined with graphite for use with gold or other metals which are not readily heated by induction.

The invention in its broader aspects therefore is not limited to the specific embodiments herein shown and described but departures may be made therefrom without departing from the principles of the invention and without sacrificing its chief advantages.

What is claimed is:

1. A casting apparatus, comprising:

investment means formed of a nonmetallic material, said investment means including a mold cavity, crucible means formed in the outer surface of said investment means and integrally therewith, and sprue means leading from said crucible means to said mold cavity;

enclosure means formed of a nonmetallic material defining a space for receiving one or more solid ingots of a casting material;

said crucible means supporting said casting material ingots within said enclosure space immediately adjacent and above said sprue means, said crucible means further including opening means cummunicating with said sprue means in said investment means, said opening means dimensioned so that the surface tension of the molten casting material retains the molten casting material within said crucible means;

means directing electromagnetic energy to said enclosure space and said crucible means for melting said casting material ingots; and means introducing compressed fluid to said enclosure space for rapidly forcing the molten casting material through said opening means of said crucible means directly into and through said sprue means to said investment mold cavity to form a casting.

2. Casting apparatus as defined in claim 1, including means for sealingly removably mounting said enclosure means about said crucible means.

3. Casting apparatus as defined in claim 1, wherein said enclosure means and said investment means are formed as a single integral unit.

4. Casting apparatus as defined in claim 1, including means directing said electromagnetic energy to said sprue means and said investment mold cavity so as to permit said molten casting material to be heated during transfer to and after reaching the investment mold cavity.

5. Casting apparatus as defined in claim 1, including means for removing ambient air from said enclosure space and means for replacing the removed air with an inert gas prior to melting of said casting material ingots.

6. Casting apparatus as defined in claim 1, wherein said casting material ingots are metal and said electromagnetic energy directing means includes a time varying magnetic field which interacts with the ingots to thereby melt the ingots by induction heating.

7. Casting apparatus as defined in claim 1, wherein said casting material ingots are nonmetallic, and said crucible means includes an ingot supporting surface which is formed from a chemically inert metallic material having a melting point higher than that of the nonmetallic casting material ingot, whereby said electromagnetic energy directing means interacts with the metallic supporting surface, thereby heating the metal and melting the nonmetallic ingot.

8. Casting apparatus as defined in claim 1, wherein said electromagnetic energy directing means includes a coil member mounted adjacent to and surrounding said enclosure space and crucible means and means for generating alternating electric current within said coil member.

9. Casting apparatus as defined in claim 1, wherein said compressed fluid is introduced at a pressure within a range between about 30 p.s.i. and about 100 p.s.i.

10. Casting apparatus as defined in claim 2, wherein said enclosure means includes an open end portion and a refractory sealing member is secured to the surface of said enclosure means forming said open end, and further including means mounting said investment means for movement into and out of sealing engagement with said refractory sealing member to form said enclosure space.

11. Casting apparatus as defined in claims 2 or 3, wherein said enclosure means has a reduced diameter from that of said investment means.

12. Casting apparatus as defined in claim 5, including means applying a low pressure to said inert gas supplied to said enclosure space during melting of said casting material ingots.

13. Casting apparatus as defined in claim 6, wherein said casting material is a precious metal and said crucible opening means are approximately 14 gauge in diameter.

14. Casting apparatus as defined in claim 6, wherein said casting material is a non-precious metal and said crucible opening means are approximately 8 gauge in diameter.

15. Casting apparatus as defined in claim 7, wherein said nonmetallic casting material is glass, said ingot supporting surface is formed of platinum and caid crucible opening means are approximately 8 gauge in diameter.

16. Casting apparatus as defined in claim 7, wherein said enclosure means is also lined with said chemically inert metallic material.

17. Casting apparatus as defined in claim 9, wherein said compressed fluid is introduced at a pressure of about 50 p.s.i.

18. Casting apparatus as defined in claim 12, wherein said pressure of said inert gas is about 0.5 p.s.i.

19. Casting apparatus as defined in claim 13, wherein said casting material is gold and said compressed fluid is introduced at a pressure of at least about 15 p.s.i.

20. Casting apparatus as claimed in claim 1, including means for introducing said compressed fluid into said enclosure space in a direction away from the molten casting material.

21. A casting method comprising the steps of:

forming a mold cavity and sprue entry means leading to said cavity within a nonmetallic investment material;

forming a depression in the outer surface of said investment material adjacent and immediately above said sprue entry means, said depression serving as a crucible in said investment material;

supporting casting material ingots in said investment crucible;

sealingly enclosing said ingots within a nonmetallic enclosure chamber;

directing electromagnetic energy to the space within said enclosure chamber to thereby melt the casting material ingots by induction heat;

dimensioning said sprue entry means so that the molten casting material is retained by surface tension within said investment crucible; and introducing a compressed fluid to said enclosed chamber space to rapidly force the molten casting material from said investment crucible through said sprue entry means to said mold cavity to form a casting.

22. A casting method as defined in claim 20, including the step of evacuating said enclosed chamber space and supplying an inert gas thereto at low pressure prior to and during heating of the casting material ingots.

23. A casting method as defined in claim 21, wherein said electromagnetic energy is also directed to said sprue entry means and said mold cavity during transfer of the molten casting material to said mold cavity.

24. A casting method as defined in claim 21, wherein said investment material is preheated immediately prior to start of the casting process to a temperature of approximately 1400° F.

25. A casting method as defined in claim 21, including the steps of sensing the temperature of the casting material within the enclosed chamber and introducing said compressed air to said chamber after the melting temperature of the casting material is reached.

26. A casting method as defined in claim 21, wherein said compressed fluid is introduced at a pressure of at least 15 p.s.i.

27. A casting method as defined in claim 21, wherein said casting material ingots are nonmetallic and including the step of lining said investment crucible with a metallic material, thereby casting nonmetallic material by induction heating.

28. A casting method as defined in claim 22, wherein said inert gas is supplied at approximately 0.5 p.s.i.

29. A casting method as defined in claim 26, wherein said compressed fluid is introduced at a pressure of at least 30 p.s.i.

30. A casting method as defined in claim 27, wherein said casting material is glass and said metallic lining is platinum.

31. A casting method as defined in claim 29, wherein said compressed fluid is introduced at a pressure of approximately 50 p.s.i.

32. A casting method as defined in claim 21, wherein said casting is gold and including the step of lining said investment crucible with graphite.

33. A casting method as defined in claim 21, including the step of forming said nonmetallic enclosure chamber integral with said nonmetallic investment material.

34. A casting method as defined in claim 21, including the step of lining the inner surface of said enclosure chamber with graphite.

* * * * *